US006234085B1

(12) United States Patent
Ramundo

(10) Patent No.: US 6,234,085 B1
(45) Date of Patent: May 22, 2001

(54) LAP TRAY WORKSTATION

(76) Inventor: Robert J. Ramundo, 547 McAlpin Ave., Cincinnati, OH (US) 45220

( * ) Notice: Subject to any disclaimer, the term of this patent is extended or adjusted under 35 U.S.C. 154(b) by 0 days.

(21) Appl. No.: 09/592,802

(22) Filed: Jun. 13, 2000

(51) Int. Cl.[7] ..... A47B 23/00
(52) U.S. Cl. ..... 108/43; 108/143
(58) Field of Search ..... 108/43, 44, 45, 108/102, 143, 137; 248/918

(56) References Cited

U.S. PATENT DOCUMENTS 905,737 * 12/1908 McCombe ..... 108/102 X
2,720,316 * 10/1955 Glascott ..... 108/102 X
3,760,744 * 9/1973 Cruckshank ..... 108/102 X
3,899,982 * 8/1975 Fetzek ..... 108/143 X
3,916,802 * 11/1975 Virtue et al. ..... 108/102 X
4,036,369 * 7/1977 Eisenberg ..... 108/102 X
4,563,091 * 1/1986 Coneglio ..... 108/102 X
5,421,646 * 6/1995 McNamara et al. ..... 108/102 X
5,971,148 * 10/1999 Jackson ..... 108/43 X
6,003,446 * 12/1999 Leibowitz ..... 108/43
6,128,182 * 10/2000 Zarek et al. ..... 108/43 X

* cited by examiner

*Primary Examiner*—Jose V. Chen
(74) *Attorney, Agent, or Firm*—Neal O. Willmann

(57) ABSTRACT

This disclosure relates to a portable lap-top workstation that is expandable to span the distance of an individual's lap to provide a comfortable, flat surface area designed to accommodate a lap-top computer and a variety of small computer related accessories.

2 Claims, 1 Drawing Sheet

FIG. 1
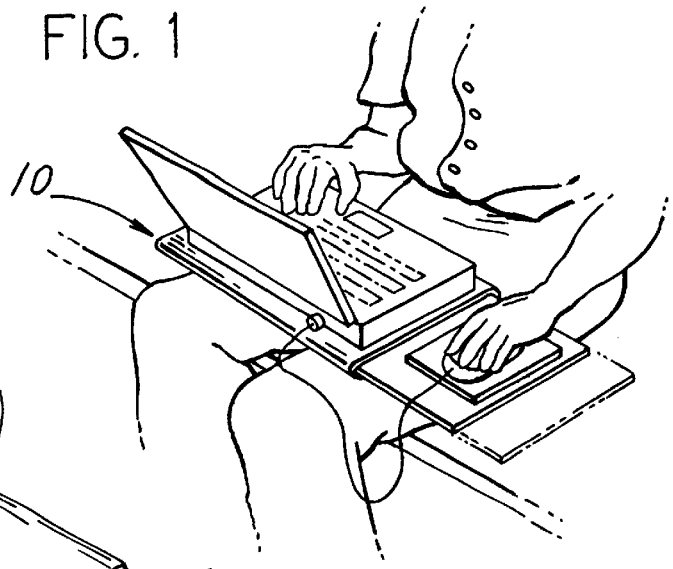
FIG. 2
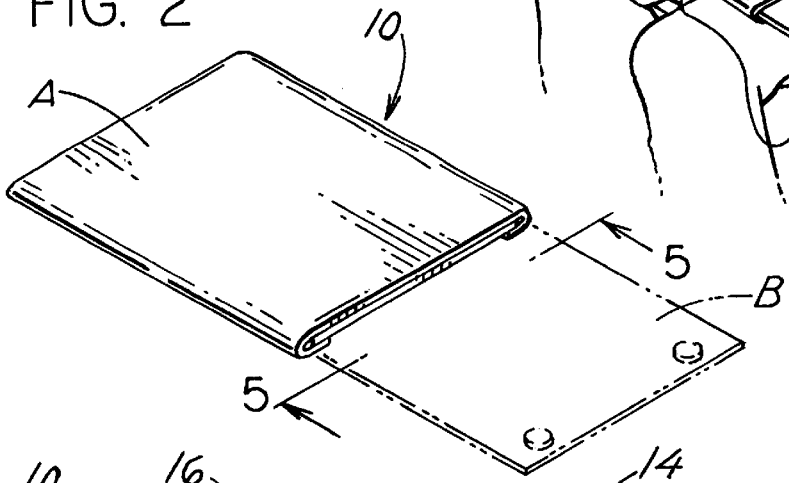
FIG. 3
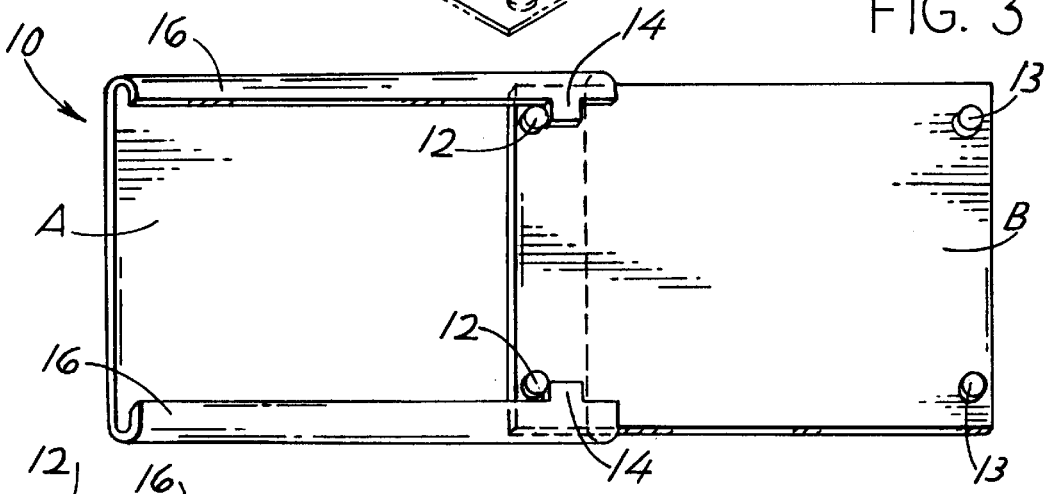
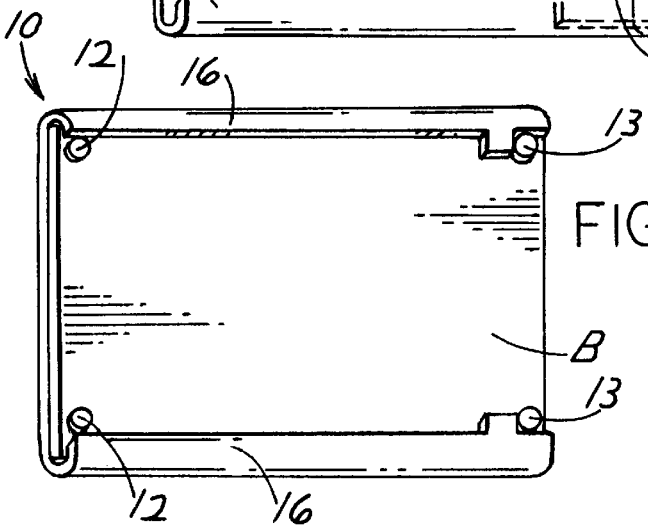
FIG. 4
FIG. 5
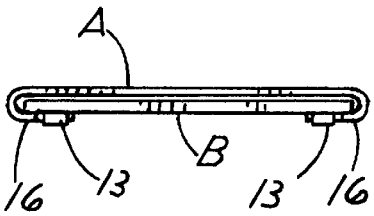

LAP TRAY WORKSTATION

BACKGROUND OF THE INVENTION

This disclosure relates generally to a tray or platform that is particularly useful for serving as a workstation by providing a comfortable work surface for using a lap-top computer. This workstation will also accommodate a variety of computer-related activities. In addition to comfortably holding a lap-top computer, the disclosed tray can support a keyboard to a desktop computer in a more comfortable fashion, and provide an alternative surface for the manipulation of a mouse.

DESCRIPTION OF THE PRIOR ART

Lap-top trays and workstations are not entirely new, and the following patent references are illustrative of the prevailing art. They describe some of the desirable features of a lap tray workstation, but differences between the disclosed trays and the tray herein disclosed will be readily apparent.

U.S. Pat. No. 5,553,824, issued to Dutra on Sep. 10, 1996, relates generally to an adjustable, 3-piece lap-top computer tray assembly which comprises relatively thin, corrugated members that slide to expand upon the user's lap to provide a support surface for a variety of portable computers.

U.S. Pat. No. 4,852,498, issued to Judd on Aug. 1, 1989 relates to a lap-top computer work station having two top covers hinged to a center base, which, when open, provide surface areas for additional tasks while the center base is supporting a lap top computer.

SUMMARY OF THE INVENTION

Notwithstanding the disclosures of the prior art, improvements in computer accessories are constantly being made, and the instant disclosure is no exception. Herein is described a portable, expandable and retractable, lap-top workstation. The workstation has a work surface that retracts to about half the size of its fully expanded mode for easy toting.

When expanded, the two flat, rigid members span the distance across the user's lap to provide a comfortable, flat surface designed primarily to accommodate the use of a lap-top computer. After use, the extended plate member can be retracted by simply sliding the two members of the tray together. Then the tray can be stored and toted, usually in the same case or valise as the lap-top computer.

Essentially, then, the disclosed tray comprises a pair of plates, one designated plate "A" and the other plate "B", wherein plate A is generally rectangular and has a pair of glide rails extending along parallel edges on the underside of said plate, and wherein plate B is generally the same configuration as plate A but slightly smaller so that it fits within the guides of plate A and slides in a planar relationship with plate A.

BRIEF DESCRIPTION OF THE DRAWING

FIG. 1 is a pictorial perspective showing the disclosed lap tray in use supporting a lap-top computer and a mouse peripheral.

FIG. 2 is an elevated perspective of the disclosed lap tray in closed orientation and with plate B of the tray shown extended in phantom.

FIG. 3 is a bottom plan view of the disclosed tray with plate B extended as in the phantom view of FIG. 2.

FIG. 4 is a bottom plan view of the disclosed tray with plate B coextensive with plate A in the "closed" position or retracted position.

FIG. 5 is the elevated end view of the disclosed tray, in the "closed" position, taken along line 5—5 of FIG. 2.

DESCRIPTION OF THE PREFERRED EMBODIMENT

The disclosed portable lap-top workstation has specifically been designed to provide comfort and utility to the thousands of computer users who are dependent on using their lap-top computers, even when they must literally be used on their laps. The disclosed workstation is, in reality, a tray that will rest on the user's lap and support a lap-top computer more effectively and comfortably than can the unaccoutered human lap.

The lap tray is essentially two interactive sliding plates that nest for easy conveyance and storage and expand to approximately twice the "nested" size to support the typical lap-top computer and other small peripherals. The plates can be made of any reasonably hard, sold material that can be molded, milled, machined or pressed into the desired configuration. When fabricated of metal, especially aluminum, the tray can act as an effective ablative, keeping a lap-top computer cooler and protecting any surface beneath the tray.

The benefits of the disclosed lap tray are legion. In addition to the comfort and ergonomic benefits afforded by the disclosed tray, the tray can be used to support various peripherals and supplies. It can be used to support reference books, notes, file folders and the like. Since it is easily and conveniently supported on the lap, it frees both hands for work or study in virtually any setting such as the office, classroom, library, backyard or park.

Because the disclosed tray rests easily on the lap, the seating position can be changed frequently to provide personal comfort and reduce the strain, stiffness and fatigue resulting from confined and prolonged sitting.

Furthermore, in addition to supporting lap-tops, the disclosed tray can be used with a desk top computer to support the keyboard to provide an alternative, and perhaps more comfortable, position for the user. The computer mouse and its accompanying pad can also be moved from the desktop to the tray for greater comfort and reduced strain on wrists and arms.

For a more detailed understanding of the disclosed tray, reference should be made to the drawing. FIG. 1 is a pictorial depiction of the disclosed tray 10 in use. More specifically, the tray is shown in its expanded mode on the lap of the user supporting both a lap-top computer and a conventional mouse. In FIG. 2, the tray 10 is shown in its compact or nested orientation with plate A generally enveloping plate B, which is also shown (in phantom) in the expanded mode.

The sliding and nesting relationship of plates A and B of the tray 10 is clearly depicted in FIG. 3. In this view, the undersides of plates A and B are shown in the expanded or extended mode. It is also evident from FIG. 3 that plate B has a sliding relationship with plate A. By having the same general shape or configuration as plate A, but slightly smaller, plate B can slide neatly beneath, and in the same plane, as plate A, nesting within the glide rails 16 of plate A. Some may prefer to think of the relationship between plates A and B as that of cabinet and a drawer.

In a preferred embodiment of the disclosed tray 10, the underside of plate B is fitted with a plurality of bumpers 12 and 13. These bumpers 12 and 13 are typically situated in one or more of the four corners on the underside of plate B and are designed to interact with one or more stops 14, typically situated on one or both glide rails 16 of plate A.

The bumpers can be made from a variety of materials, but preferably they're made of a soft, pliant and resilient material such as an organic plastic, silicone or rubber. However, they could just as easily be made of the same material as the plates and molded or machined on to plate B.

FIG. 3 is a preferred embodiment of the tray 10 in the extended mode with plate B extending beyond the perimeter of plate A. In this embodiment, plate B is confined in its lateral movement by the encounter of bumpers 12 with stops 14. When plate B is returned to the tray's compact mode by a planar slide within the confines of the glide rails of plate A, its lateral movement will again be arrested by bumpers encountering the stops 14 of plate A. This time, however, the bumpers encountering stops 14 are the bumpers 13 positioned on the extended edge of plate B. This encounter is depicted in FIG. 4.

While the stops could conceivably be situated in several locations on plate A where they could limit the planar movement of plate B, it is preferred that they be placed or situated on the rails of plate A. And in a preferred mode, a stop will be situated on each rail, each diametrically, so to speak, opposed to or opposite the other.

FIG. 5 is offered to illustrate how neatly and compactly the two plates can be nested, one within the other, for easy packing and storage, typically within the canvas lap-top case.

While the foregoing is a detailed and complete description of the preferred embodiments of the disclosed lap-top tray, it should be apparent that numerous variations and modifications can be made and employed to implement the all-important purpose of the tray without departing from the spirit of the invention, which is fairly defined by the appended claims.

What I claim is:

1. A lap tray suitable for supporting a lap-top computer which comprises:

a pair of plates, one designated plate "A" and the other plate "B", wherein plate A is generally rectangular and has a pair of glide rails extending along parallel edges on the underside of said plate and wherein one of said glide rails has a stop; and wherein plate B is generally the same configuration as plate A but slightly smaller so as to fit within the glide rails of plate A to move in a planar relationship to plate A; and wherein plate B has a quartet of bumpers positioned generally in the corners of the underside of said plate and wherein said stop is positioned to restrict the planar movement of plate B by engaging with two of the bumpers of plate B.

2. A lap tray according to claim 1 wherein both glide rails of plate A have stops restricting the planar movement of plate B by engaging with all four bumpers of plate B.

* * * * *